US007604702B2

(12) United States Patent
Mouser et al.

(10) Patent No.: US 7,604,702 B2
(45) Date of Patent: Oct. 20, 2009

(54) METHOD, APPARATUS, AND SYSTEM FOR BI-SOLVENT BASED CLEANING OF PRECISION COMPONENTS

(75) Inventors: Wayne L. Mouser, Maple Grove, MN (US); Russell Manchester, Waconia, MN (US); William Barrett, Richfield, MN (US); Fredrick Bergman, Plymouth, MN (US)

(73) Assignee: Crest Ultrasonics Corp., Trenton, NJ (US)

( * ) Notice: Subject to any disclaimer, the term of this patent is extended or adjusted under 35 U.S.C. 154(b) by 764 days.

(21) Appl. No.: 11/259,947

(22) Filed: Oct. 27, 2005

(65) Prior Publication Data

US 2006/0094627 A1 May 4, 2006

Related U.S. Application Data

(60) Provisional application No. 60/623,847, filed on Oct. 29, 2004.

(51) Int. Cl.
*B08B 3/04* (2006.01)

(52) U.S. Cl. ..... 134/26; 134/1; 134/10; 134/22.1; 134/34; 134/36; 134/42; 134/104.4; 134/105; 134/110; 210/737; 210/748; 210/774

(58) Field of Classification Search ..... 134/1, 134/10, 22.1, 26, 34, 36, 42, 104.4, 105, 134/110; 210/737, 748, 774
See application file for complete search history.

(56) References Cited

U.S. PATENT DOCUMENTS

| | | | | |
|---|---|---|---|---|
| 3,710,450 | A * | 1/1973 | Figiel | 34/337 |
| 4,983,223 | A | 1/1991 | Gessner | |
| 5,085,238 | A | 2/1992 | Baldwin | |
| 5,114,496 | A | 5/1992 | Bordunov | |
| 5,244,575 | A | 9/1993 | Marshall | |
| 5,300,154 | A * | 4/1994 | Ferber et al. | 134/26 |
| 5,679,175 | A | 10/1997 | Hayes et al. | |
| 5,773,398 | A * | 6/1998 | Joye et al. | 510/245 |
| 6,017,398 | A | 1/2000 | Scotto et al. | |
| 6,026,588 | A | 2/2000 | Clark et al. | |
| 6,231,684 | B1 | 5/2001 | Mouser et al. | |
| 2005/0227898 | A1 * | 10/2005 | Leskowicz et al. | 510/407 |

* cited by examiner

*Primary Examiner*—Sharidan Carrillo
(74) *Attorney, Agent, or Firm*—Patterson, Thuente, Skaar & Christensen, P.A.

(57) ABSTRACT

A bi-solvent cleaning system for cleaning precision components without the use of VOC solvents. The bi-solvent cleaning system provides for is a two mode operation for cleaning and rinsing precision components using VOC exempt solvents that is as effective as prior art VOC solvent based systems while subsequently allowing for recovery and reuse of a VOC exempt solvent.

9 Claims, 10 Drawing Sheets

METHOD, APPARATUS, AND SYSTEM FOR BI-SOLVENT BASED CLEANING OF PRECISION COMPONENTS

PRIORITY CLAIM

The present application claims priority to U.S. Provisional Application No. 60/623,847, filed Oct. 29, 2004, and entitled, "METHOD, APPARATUS, AND SYSTEM FOR NON-VOC BASED CLEANING OF PRECISION COMPONENTS," which is herein incorporated by reference to the extent not inconsistent with the present disclosure.

FIELD OF THE DISCLOSURE

The present invention relates generally to a solvent based cleaning system for precision cleaning of parts. In particular, the invention relates to a bi-solvent cleaning system for precision parts utilizing a solvent reclamation process to reduce overall solvent discharge.

BACKGROUND OF THE DISCLOSURE

Precision cleaning and drying systems typically utilize a wide variety of cleaning solutions including various solvents, detergents, or other aqueous mixtures. These systems operate to clean and dry various devices or parts such as medical devices, optical instruments, wafers, PC boards, hybrid circuits, disk drive components, precision mechanical or electromechanical components, or the like.

Many prior art systems make use of solvents classified as VOC's or Volatile Organic Compounds. VOC's are organic chemicals that have high vapor pressures such that VOC's can easily form vapors at ambient temperatures and pressure. While VOC's can be successful in precision cleaning system, the use and disposal of VOC's is heavily regulated due to concerns regarding harmful environmental and heath effects resulting from exposure and/or discharge of VOC's.

SUMMARY OF THE DISCLOSURE

An object of the present invention is to create a suitable cleaning system and suitable cleaning methods for cleaning precision components while utilizing a solvent reclamation process to reduce solvent discharge while recovering solvents for reuse and/or disposal. The present invention comprises a bi-solvent design for cleaning precision components using two solvents to remove soil and other contaminants. In one representative embodiment, the two solvents can comprise a first VOC-exempt solvent and a second VOC-exempt solvent wherein the VOC-exempt solvents generally are as effective as VOC solvents. An operation mode comprises cleaning a precision component within a first VOC exempt solvent to remove any soil, particulate matter, grease or other contaminant from the precision component followed by rinsing of the precision component within a second tank containing a second VOC exempt solvent to remove any film left on the precision component by the first VOC exempt solvent. During the operation mode, the cleaning and ringing steps can each comprise subjecting the precision component to oscillation and ultrasonically induced cavitation within the corresponding solvent to further assist with cleaning and rinsing. A solvent recovery mode comprises separating the first VOC exempt solvent, removed as part of the rinsing step, from the second VOC exempt solvent. In one representative embodiment, the second VOC-exempt solvent can be more expensive than the first VOC-exempt solvent such that the second VOC exempt solvent is recovered and reclaimed for reuse while the first VOC exempt solvent, as well as any contaminants within the first VOC exempt solvent, can be properly disposed of.

In some representative embodiments, the disclosure describes a method for cleaning precision components with a bi-solvent cleaning system having a solvent reclamation system.

In some representative embodiments, the disclosure describes a bi-solvent cleaning system for cleaning precision components while providing for recovery and/or disposal of two solvents.

In some representative embodiments, the disclosure describes a cleaning apparatus comprising tanks and associated plumbing to facilitate the cleaning of precision components with a bi-solvent cleaning system having a solvent recovery system.

In some representative embodiments, the disclosure describes a method for disposing of a first VOC exempt solvent and recovering a second VOC exempt solvent with a bi-solvent cleaning system.

As used throughout the present disclosure, the term "VOC exempt solvent" is defined to include organic compounds determined by the United States Environmental Protection Agency to have negligible photochemical reactivity and that are specified in the United States Code of Federal Regulations at 40 C.F.R. 51.100(s), which is incorporated by reference.

The above summary of the various embodiments of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
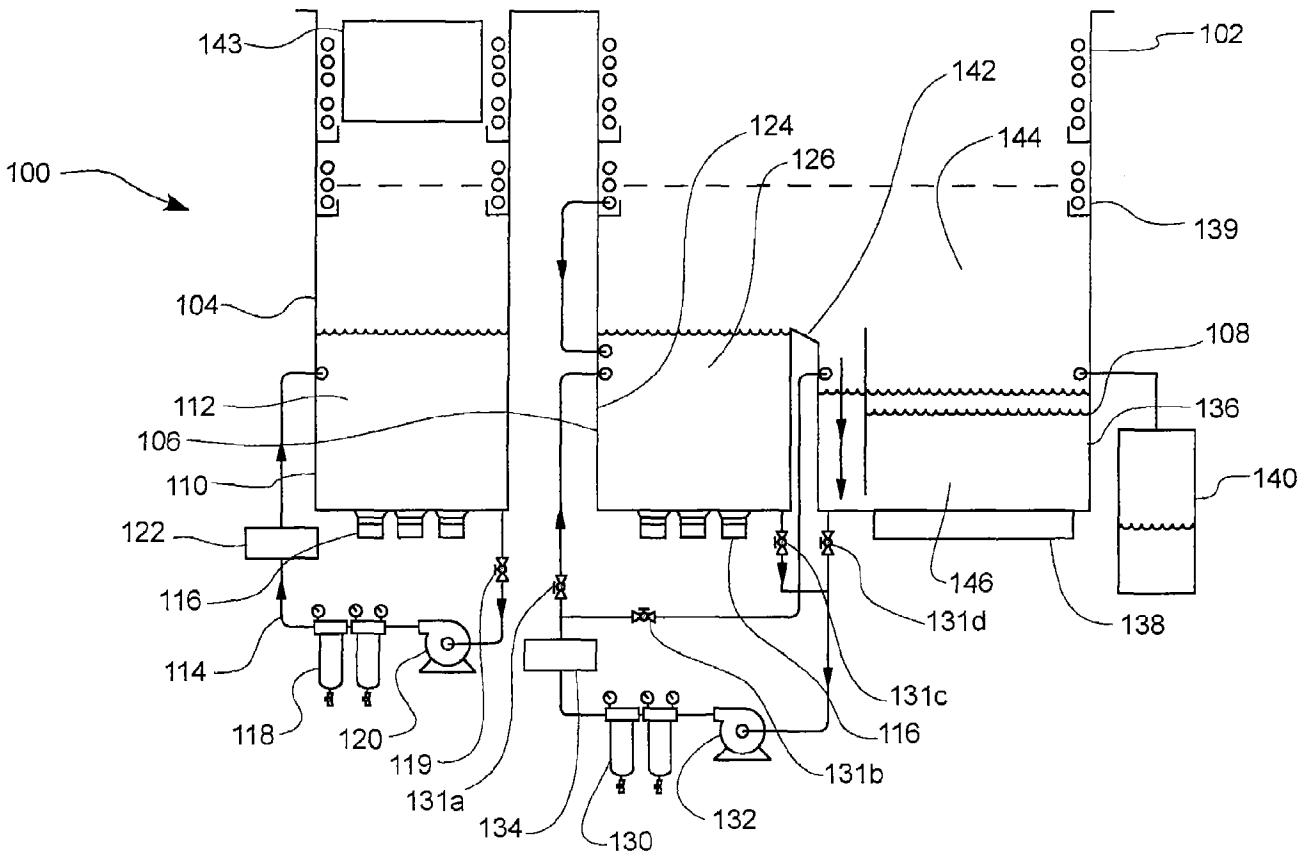
FIG. 1 is a schematic view of a cleaning system of the present disclosure representative of a cleaning and rinsing mode.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DISCLOSURE

Figure 2:
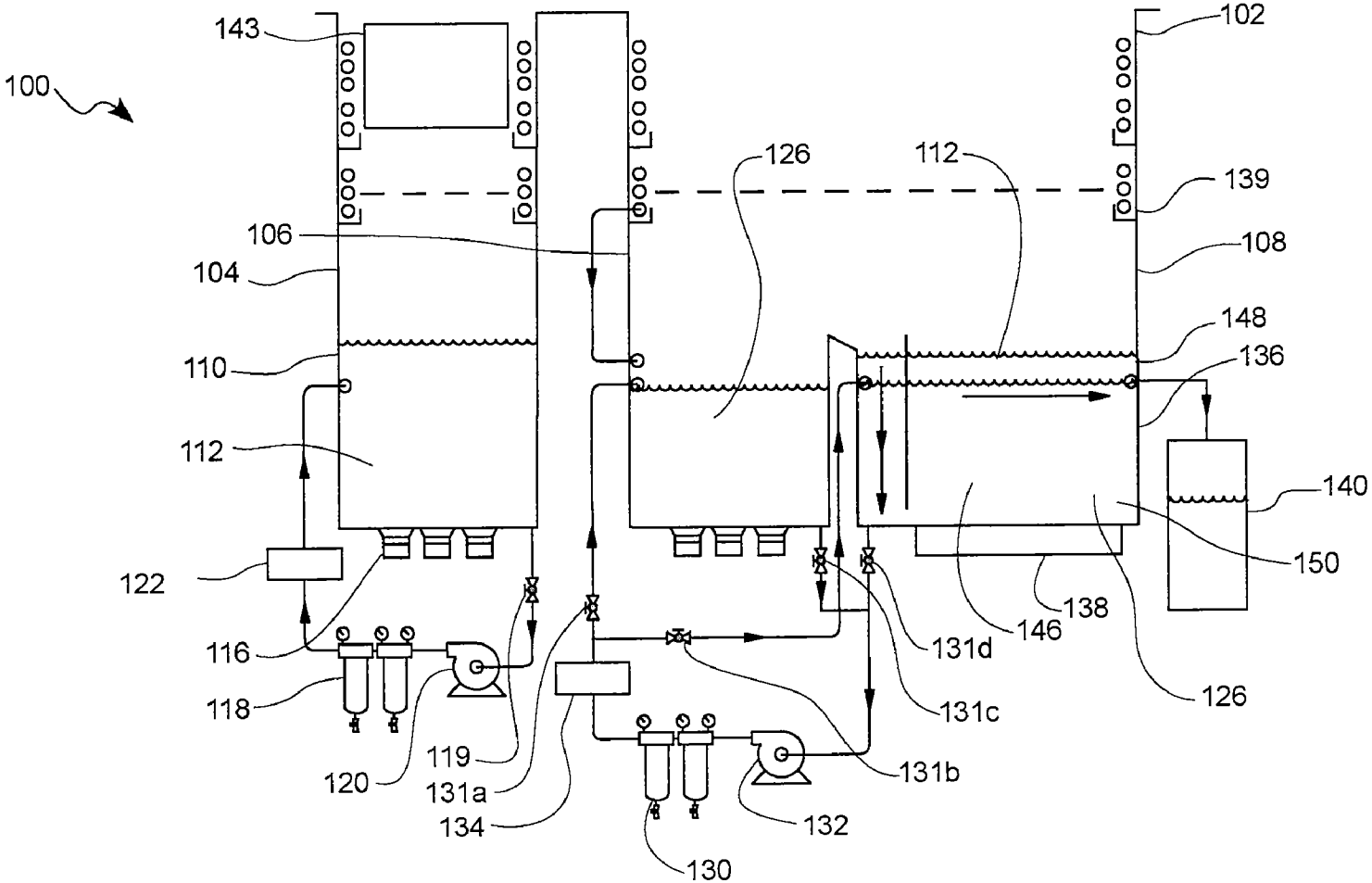
FIG. 2 is a schematic view of the cleaning system of FIG. 1 representative of a solvent recovery and waste disposal mode.

A bi-solvent cleaning system 100 of the disclosure is illustrated in FIGS. 1 and 2. The bi-solvent cleaning system 100 is designed and adapted for cleaning of precision components such as, for example medical devices, optical instruments, wafers, PC boards, hybrid circuits, disk drive components, precision mechanical or electromechanical components, or the like. In some presently preferred embodiments, the bi-solvent cleaning system 100 comprises a single integrated system that is self-contained such that no substantial interconnection is required between the components of the bi-solvent cleaning system. For example, the bi-solvent cleaning system can be mounted on a single skid or frame and/or contained within a single housing, container or compartment.

As illustrated in FIGS. 1 and 2, bi-solvent cleaning system 100 can comprise a system housing 102, a cleaning portion 104, a rinsing portion 106 and a solvent recovery portion 108. The various components including cleaning portion 104, rinsing portion 106 and a solvent recovery portion 108 can be operably interconnected within the system housing 102 such that a single, unitized structure can be tested, shipped and installed.

Cleaning portion 104 generally comprises a cleaning tank 110, a first solvent 112 and a first recirculation loop 114. Cleaning tank 110 can comprise an open tank constructed of suitable materials such as stainless steel, tantalum, titanium, quartz or polymers such as PEEK and other suitable materials. Cleaning tank 110 can further comprise at least one ultrasonic transducer 116 for promoting the cleaning process. The ultrasonic energy causes alternating patterns of low and high-pressure phases within the first solvent 112. In the low-pressure phase, bubbles or vacuum cavities are formed. In the high-pressure phase, the bubbles implode violently. This process of creating and imploding bubbles is commonly referred to as cavitation. Cavitation results in an intense scrubbing process along the surface of the precision components causing any particulates to be removed from the parts. The bubbles created during cavitation are minute and as such are able to penetrate microscopic crevices to provide enhanced cleaning as compared to simple immersion or agitation cleaning processes. In a representative embodiment, ultrasonic transducer 116 is a Crest Ultrasonic Corp. ceramic enhanced transducer capable of supplying ultrasonic energy at a suitable frequency of between 28 KHz and 2.5 MHz. Ultrasonic transducer 116 can be bonded directly to the exterior of the cleaning tank 110 with an adhesive such as epoxy.

First recirculation loop 114 comprises a flow system wherein the first solvent 112 is recirculated through a first filter system 118 to remove particulates introduced as the precision components are cleaned. Filter system 118 can comprise one or more suitable filter arrangements for removing these particulates. Filter system 118 make comprise prepackaged filters including a filter media, for example polyether sulfone, Teflon®, PVDF, polyester, or polypropylene, capable of removing particulates down to 0.03 microns in size. First recirculation loop 114 further comprises a valve 119 and a first recirculation pump 120. Valve 119 can comprise an automated valve such as, for example, a solenoid valve, or a hand-actuated manual valve. First recirculation pump 120 functions to continually recirculate the first solvent 112 through the first filter system 118. First recirculation loop 114 can further comprise a first heat exchanger 122 for continually heating the first solvent 112 as it is reintroduced to the cleaning tank 110. Through the use of first heat exchanger 122, cleaning tank 110 can be maintained at a continuous temperature as heat energy lost through conduction, convection and radiation is replaced.

In one presently preferred embodiment, first solvent 112 can comprise a suitable VOC exempt solvent with solvent characteristics that promote the removal of contaminants such as soil, particulates, oils and greases. For example, first solvent 112 can have a kari-butanol value of about 60. In one representative embodiment, first solvent 112 comprises a soybean-based VOC exempt solvent, such as, for example, Soyclear 1500 available from Ag Environmental Products of Omaha, Nebr., having a boiling point of 333° C. Preferably, first solvent 112 is biodegradable and/or non-hazardous. One advantage of a soy-based solvent is that these types of solvents are generally inexpensive due to the readily available nature of soybeans. Furthermore, no special and/or expensive disposal equipment and/or methods are generally required for disposing of the soy-based solvent, for instance when the levels of oils and/or greases reach a high enough level within cleaning tank 110, the first solvent 112 is dumped and replaced with fresh solvent. Soy based solvents can be disposed using traditional methods such as, for example, combustion in an incinerator or used as a fuel stream source in combination with heating oil inside a boiler.

Rinsing portion 106 generally comprises a rinse tank 124, a second solvent 126 and a recovery loop 128. In addition to second solvent 126, rinse tank 124 can include residual amounts of first solvent 112 introduced to rinse tank 124 as a film on the precision components. Rinse tank 124 can comprise an open tank constructed of the same or similar materials as first cleaning tank 100, for example suitable materials such as stainless steel, tantalum, titanium, quartz or polymers such as PEEK and other suitable materials. Rinse tank 124 can further comprise at least one ultrasonic transducer 116 for inducing cavitation within the rinse tank 124 to further assist the cleaning process.

Recovery loop 128 comprises a flow system wherein the second solvent 126, as well as residual first solvent 112 is recirculated through a second filter system 130 to remove particulates from the rinse tank 124. Second filter system 130 can comprise one or more suitable filter arrangements for removing these particulates. Recovery loop 128 further comprises a plurality of valves 131*a*, 131*b*, 131*c*, 131*d* and a second recirculation pump 132. Valves 131*a*, 131*b*, 131*c*, 131*d* can comprise an automated valve such as, for example, a solenoid valve, or a hand actuated manual valve. Second recirculation pump 132 functions to selectively pump an appropriate liquid through the recovery loop 128 based on a mode of operation and the operational status of valve 131*a*, 131*b*, 131*c*, 131*d*. Recovery loop 128 can further comprise a second heat exchanger 134 for cooling the second solvent 126 and the residual first solvent 112.

In one presently preferred embodiment, second solvent 126 can comprise a suitable VOC exempt solvent with solvent characteristics that promote the removal of any film left on the precision component by first solvent 112. For example, second solvent 126 can have a kari-butanol value between about 10 to about 150. In one representative embodiment, second solvent 126 comprises an engineered solvent such as, for example, Novec™ Engineered Fluid HFE-7200 available from the 3M Company of St. Paul, Minn. HFE-7200 has a boiling point of 61° C. and a wide liquid range from −135° C. to 61° C. making it an excellent solvent for vapor degreasing applications. In addition, HFE-7200 is non-ozone depleting, has very low global warming potential, offers reduced greenhouse gas emissions, is not a VOC and is approved without restrictions under the United States Environmental Protection Agencies Significant New Alternatives Program.

Solvent recovery portion 108 can comprise a recovery tank 136, a recovery heater 138, a condensing coil 139 and a waste tank 140. Recovery tank 136 can comprise an open tank constructed of the same or similar materials as first cleaning tank 100 and rinse tank 124, for example suitable materials such as stainless steel, tantalum, titanium, quartz or polymers such as PEEK and other suitable materials. Recovery tank 136 is physically attached to and separated from rinse tank 124 at an overflow weir 142. As such, recovery tank 136 and rinse tank 124 share a common vapor blanket 144.

When fully assembled and integrated, bi-solvent cleaning system 100 can be configured for automated, semi-automated or manual operation. In addition to the aforementioned and described components, bi-solvent cleaning system further comprises a precision component handling system for moving precision parts between the cleaning tank 110 and the rinse tank 124 by placing the parts within a carrier or basket 143. This precision component handling system can comprise a manual system wherein an operator simply places the precision component in the correct tank or it may comprise an automated parts handling system for moving the basket 143 from the cleaning tank 110 to the rinse tank 124. In addition, bi-solvent cleaning system 100 may comprise suitable lights, buttons and switches for manual operation of the bi-solvent cleaning system 100. Alternatively, bi-solvent cleaning system 100 can be capable of automated operation such as, for example, operation controlled and initiated by a microprocessor, personal computer, Programmable Logic Controller (PLC) and the like.

In a preferred embodiment, the bi-solvent cleaning system 100 is fully contained within the system housing 102, such as, for example a cabinetized housing to present a pleasing, aesthetic appearance. In such a cabinetized system, a user need only supply the first solvent 112, the second solvent 126, the precision components to be cleaned and an electrical power source.

During operation, the bi-solvent cleaning system 100 can be run in one of two modes, first mode being for normal operation where precision components are cleaned and rinsed as illustrated in FIG. 1 and the second mode comprising a multi-step process for separating the first solvent 112 and the second solvent 126 followed by removal and potential disposal of the first solvent 112 and reclamation of the second solvent 126 for reuse within the bi-solvent cleaning system 100 as illustrated in FIG. 2. With respect to the operation of second rinsing component 106 and recovery component 108 during the first mode and second mode, specific reference is made to FIGS. 3-10, which, are further described below.

Normal Operation

Figure 3:
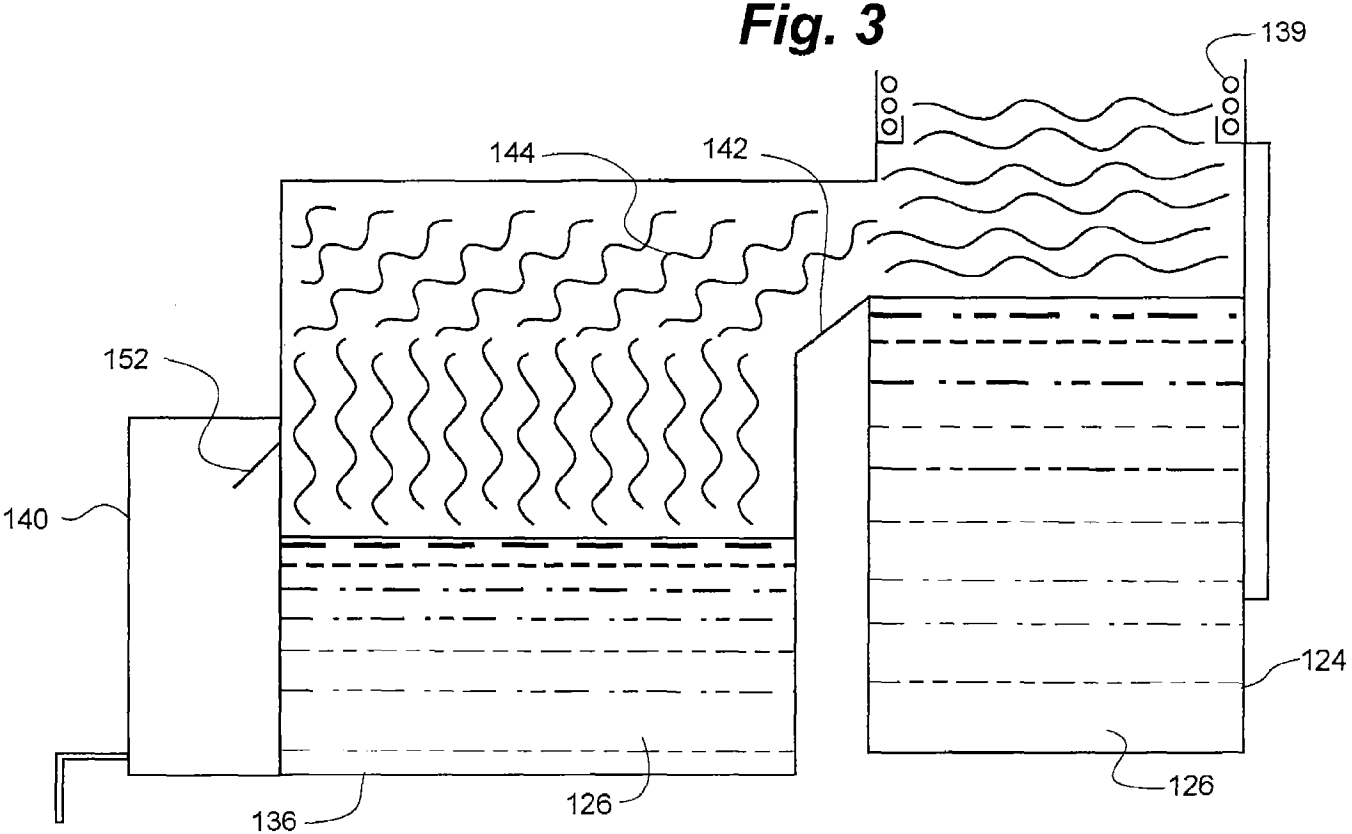
FIG. 3 is a schematic view of a rinse tank and recovery tank of the cleaning system of FIG. 1 in a start-up mode.
Figure 4:
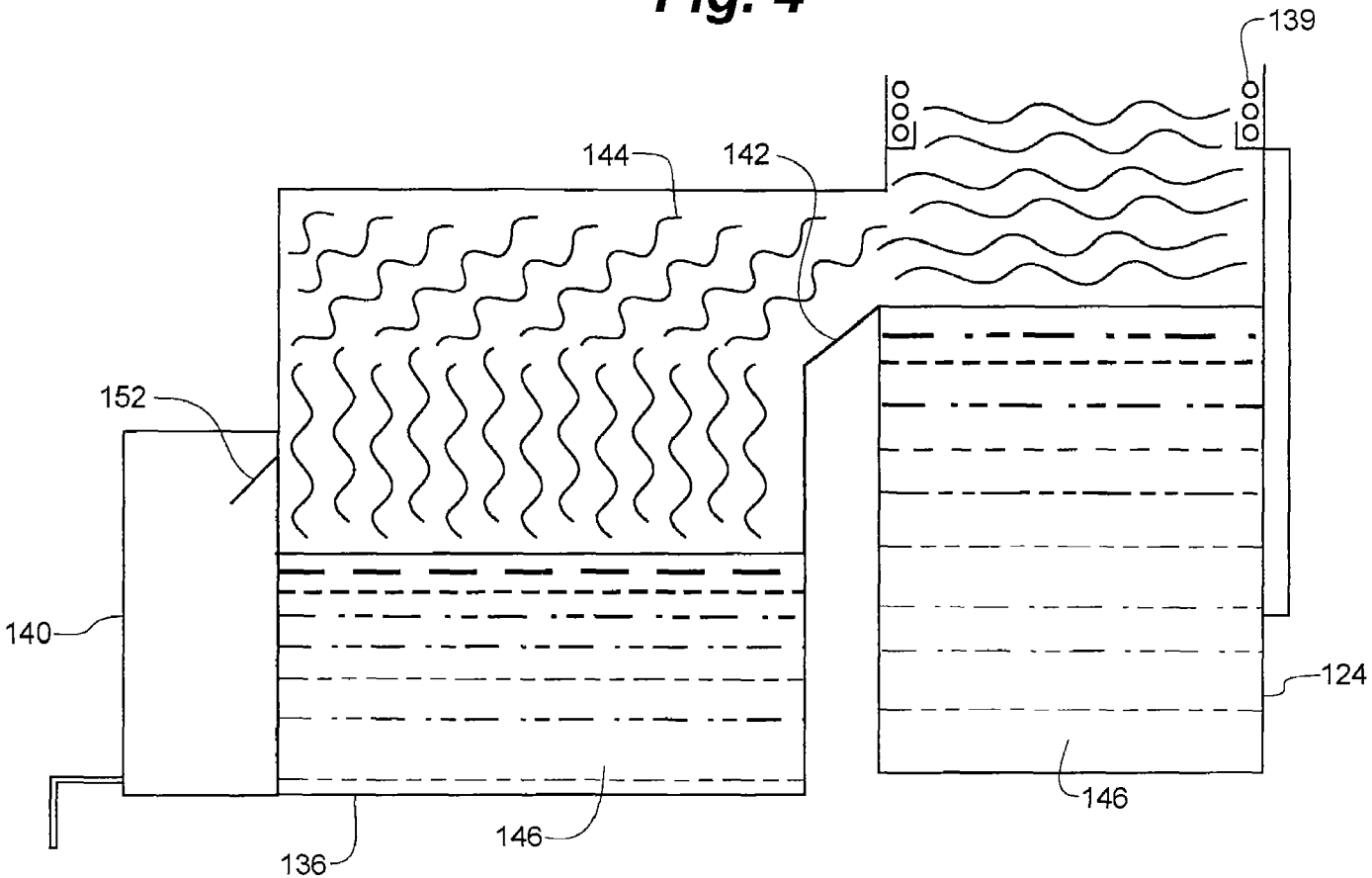
FIG. 4 is a schematic view of a rinse tank and recovery tank of the cleaning system of FIG. 1 in a continuous cleaning mode.

As illustrated in FIGS. 1, 3 and 4, operation of the bi-solvent cleaning system 100 is initiated by commencing recirculation and heating portions of the bi-solvent cleaning system to achieve the desired operational parameter. Within cleaning portion 104, first solvent 112 is pumped through the first recirculation loop 114 such that first heat exchanger 122 can add heat energy to the first solvent 112 and consequently, heat the cleaning tank 110. During operation, cleaning tank 110 is maintained at a generally constant temperature such as, for example, about 70° C. for Soyclear 1500. It will be understood by one of skill in the art that cleaning tank 110 and first recirculation loop 114 can include suitable sensors, meters and alarms such that proper temperatures, flow rates, pressures and other process variables can be monitored and maintained during cleaning.

At initial start-up of the bi-solvent cleaning system 100 operation, rinse tank 124 and recovery tank 136 each contain second solvent 126 as illustrated in FIG. 3. Recovery heater 138 is activated to heat the recovery tank 136 to the boiling point of the second solvent 126, or 61° C. in the case of HFE-7200. At the same time, condensing coil 139 is operated at about 5° C. such that the vapor blanket 144 comprising vapors of second solvent 126 is formed directly above the rinse tank 124 and the recovery tank 136. The condensing coil 139 causes the vapors of the second solvent 126 to condense such that a pure distillate of second solvent 126 continually flows down the walls and into rinse tank 124. As the pure distillate of second solvent 126 flows into the rinse tank 124, the level of second solvent 126 within the rinse tank 124 rises until it reaches the level of the overflow weir 142 wherein second solvent 126 cascades into the recovery tank 136. During normal operation, valves 131*a*, 131*c* are opened while valves 131*b*, 131*d* are closed such that second recirculation pump 132 pumps the contents of rinse tank 124 through the second filter system 130 to filter and remove any particulates within rinse tank 124. Through the continued addition of distillate second solvent 126 and the addition of pump energy from recirculation pump 132, the temperature of rinse tank 124 remains at about 51° C.

In a normal cleaning and rinsing mode as illustrated in FIG. 1, the precision component is placed into the cleaning tank 110, for example by placing the precision component in basket 143. Basket 143 is submerged within the first solvent 112 such that any particulate matter, soil, oils, grease and other contaminants can be removed from the precision component and suspended within the first solvent 112. As basket 143 and, consequently, the precision component is submerged within the first solvent 112, ultrasonic transducer 116 can induce cavitation within the first solvent 112 to further promote the removal of contaminants from the precision component. When basket 143 is used as part of an automated handling system, basket 143 can be continually oscillated in an up/down and/or side-to-side manner to further assist in removing contaminants from the precision component. First solvent 112 is continually recirculated through the first recirculation loop 114 wherein any suspended particulates introduced by the precision components can be removed from the first solvent 112 using the first filter system 118.

After the precision component has been cleaned of particulates in the cleaning tank 110, the precision component is transferred to the rinse tank 124 using basket 143. When placed in the rinse tank 124, small amounts of the first solvent 112 can remain on the precision component. The second solvent 126 rinses any remaining particulates and dissolves the first solvent 112 from the precision component. This rinsing can be further encouraged within the rinse tank 124 through the use of ultrasonic transducers 116 to introduce cavitation within the rinse tank 124. In addition, basket 143 can be oscillated in an up/down and/or side-to-side manner to further promote contaminant removal from the precision component. After cleaning, the basket 143 is removed from the rinse tank 124 wherein the vapor blanket 144 dries the precision component such that it includes no film or residue. The precision component is then prepared for further processing or use.

Within the rinse tank 124, the level of the second solvent 126 remains at a steady-state level such that there is constant overflow over the overflow weir 142 and into recovery tank 136. As precision components are rinsed in the rinse tank 124, the second solvent 126 is continually contaminated by dissolved amounts of first solvent 112 as well as any other contaminants present on the precision component. As such, the overflow into recovery tank 136 introduces a solvent mixture 146 of first solvent 112, second solvent 126 and any other contaminants into the recovery tank 136 as illustrated in FIG. 4. As the first solvent 112 is selected to have a higher boiling point, preferably much higher, than the second solvent 126, second solvent 126 continues to be boiled off of the solvent mixture 146 which, over time, causes the amount of first solvent 112 to accumulate and increase within the recovery tank 136. Eventually, the concentration of first solvent 112 within the recovery tank 136 increases to the point wherein the boiling point of the solvent mixture 146 is caused to increase, eventually reaching a point where separation of the solvent mixture 146 becomes necessary.

Separation and Disposal Operation

A solvent disposal and recovery mode for the bi-solvent cleaning system 100 is illustrated in FIGS. 2 and 5-10. As illustrated in FIG. 4, continued operation of the bi-solvent cleaning system 100 eventual leads to the concentration of first solvent 112 within the recovery tank 136 reaching an unacceptable level as evidenced by an increase in the boiling point of the solvent mixture 146 such as, for example, an increase of 10° C. or more. Separation of the solvent mixture 146 (including any dissolved contaminants) is accomplished by cooling the temperature of the solvent mixture 146 within the recovery tank 136 to 50° C. such that two distinct liquid levels are formed, a first solvent portion 148 comprising first solvent 112 (including any soil contamination) and a second solvent portion 150 comprising second solvent 126. First solvent portion 148 and second solvent portion 150 are generally visually distinguishable to the unassisted eye.

Figure 5:
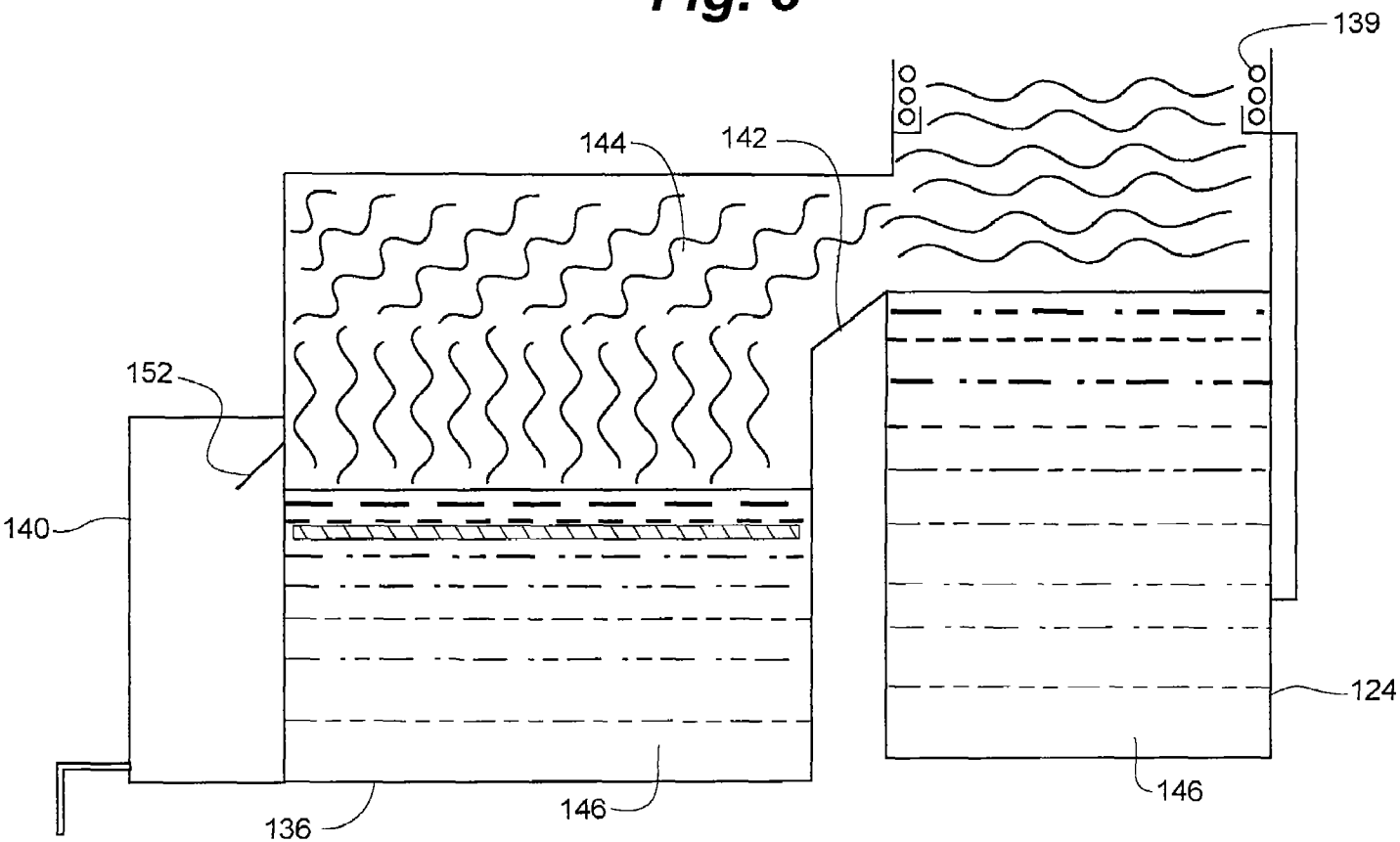
FIG. 5 is a schematic view of a rinse tank and recovery tank of the cleaning system of FIG. 1 in a first step of a solvent recovery mode.
Figure 6:
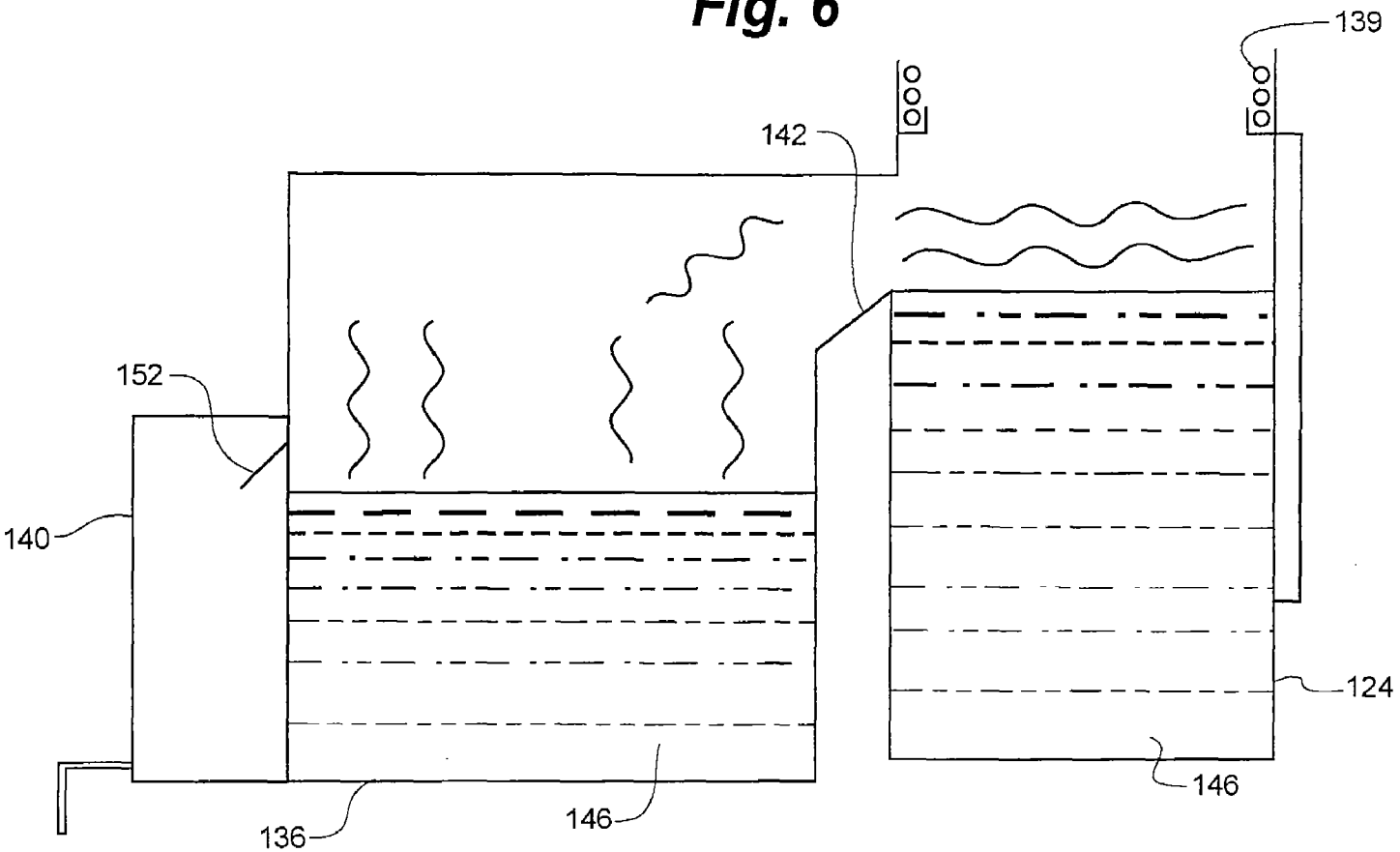
FIG. 6 is a schematic view of a rinse tank and recovery tank of the cleaning system of FIG. 1 in a second step of the solvent recovery mode.
Figure 7:
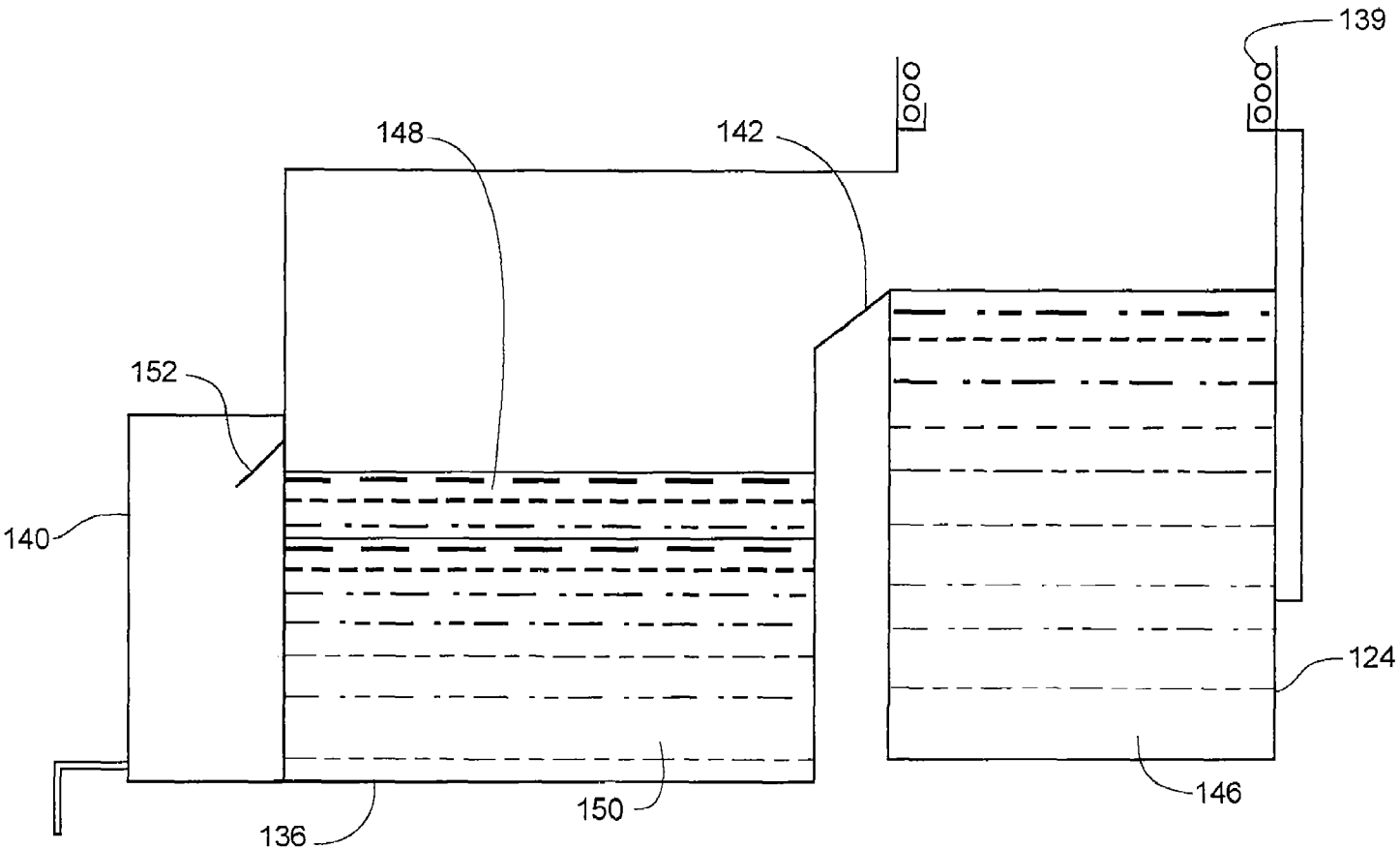
FIG. 7 is a schematic view of a rinse tank and recovery tank of the cleaning system of FIG. 1 in a third step of the solvent recovery mode.

Cooling within the recovery tank 136 is accomplished by turning off the recovery heater 138, turning off the condenser coil 139 such that vapor blanket 144 collapses and recirculating the liquid within recovery tank 136 through the recovery loop 128 by opening valves 131*b*, 131*d* while closing valves 131*a*, 131*c* such that the liquid can be cooled by the second heat exchanger 134. As the solvent mixture 146 cools, second solvent 126 is no longer boiled off of solvent mixture 146 such that pure distillate of the second solvent 126 stops condensing at the condenser coil 139 and no longer fills rinse tank 124 such the level of second solvent 126 within the rinse tank 124 drops to the level of the overflow weir 142 and no longer cascaded into the recovery tank 136 as illustrated in FIGS. 4, 5 and 6. It will be understood by one of skill in the art that rinse tank 124, recovery tank 136 and recovery loop 128 can include suitable sensors, meters and alarms such that proper temperatures, flow rates, pressures and other process variables can be monitored and maintained during cleaning. As the recovery tank is cooled to 50° C., solvent mixture 146 is separated into first solvent portion 148 and second solvent portion 150 as illustrated in FIG. 7.

Figure 8:
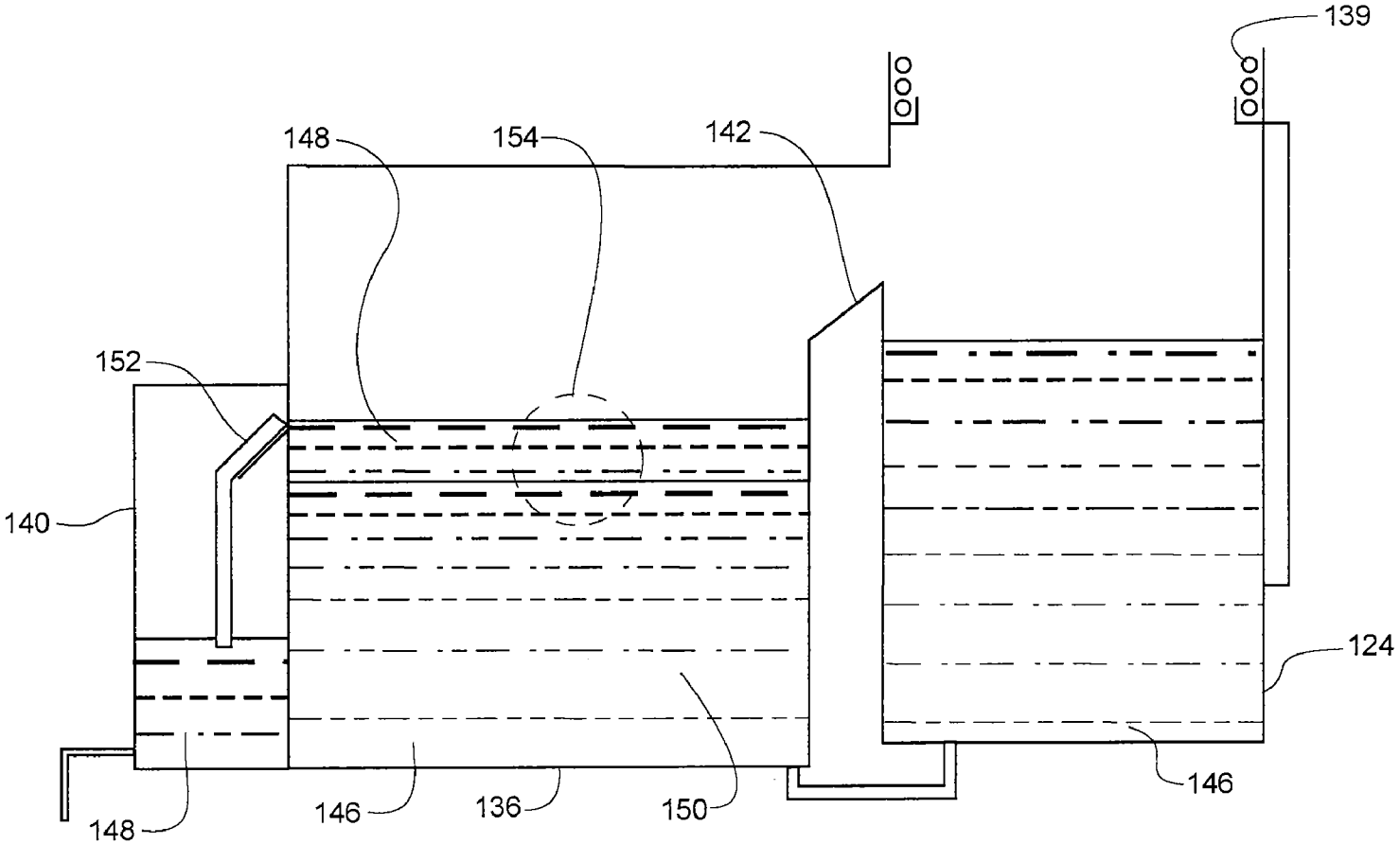
FIG. 8 is a schematic view of a rinse tank and recovery tank of the cleaning system of FIG. 1 in a fourth step of the solvent recovery mode.
Figure 9:
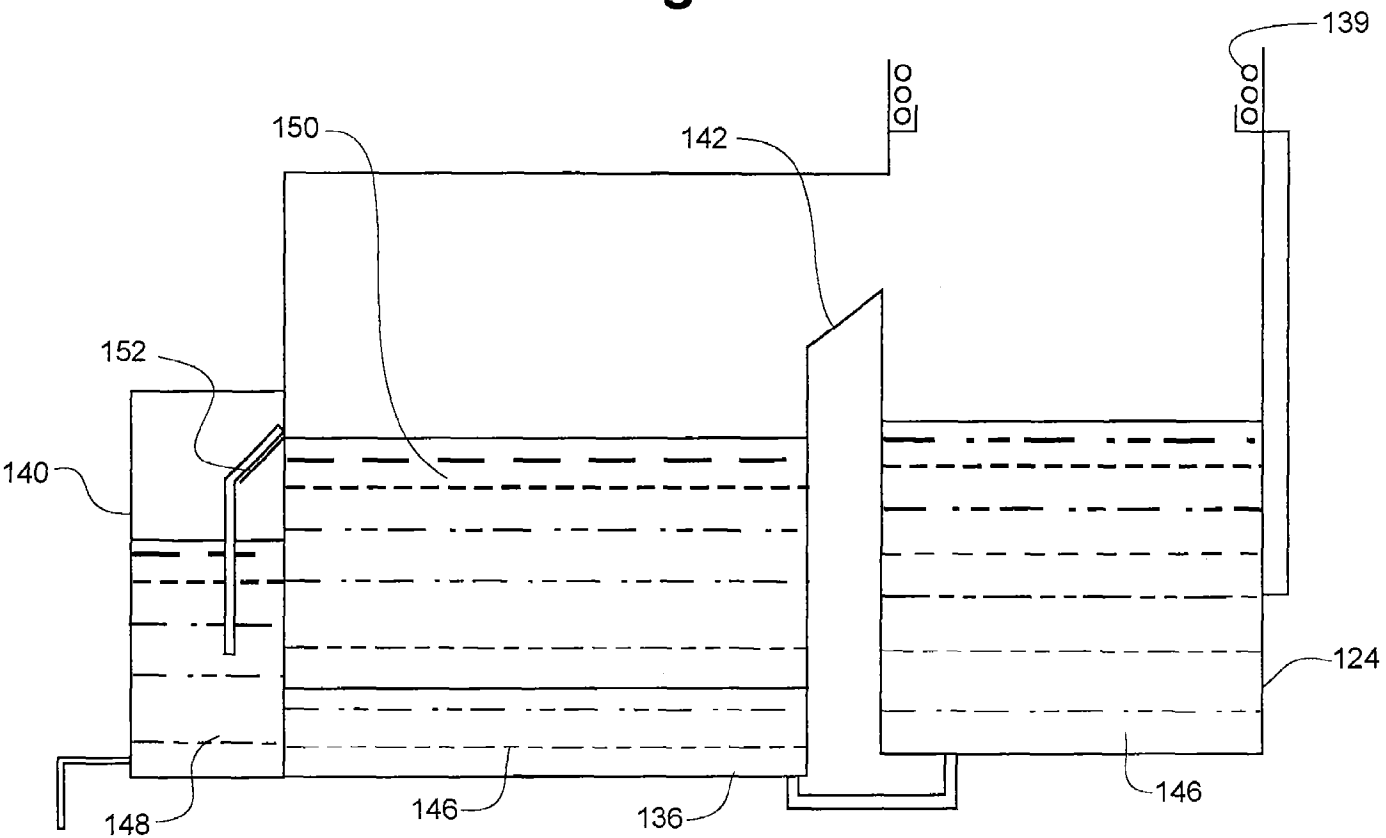
FIG. 9 is an a schematic view of a rinse tank and recovery tank of the cleaning system of FIG. 1 in a fifth step of the solvent recovery mode.
Figure 10:
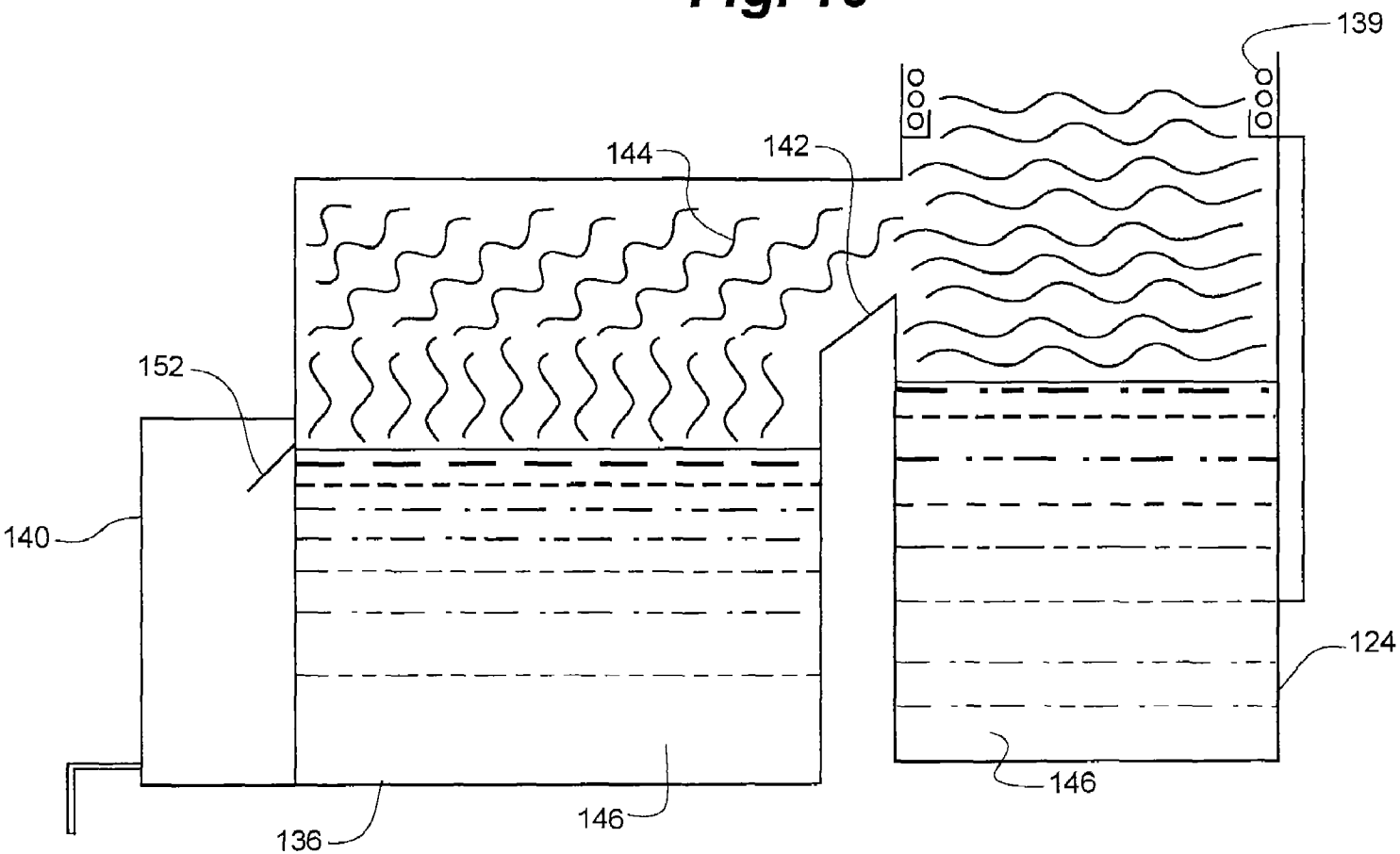
FIG. 10 is a schematic view of a rinse tank and recovery tank of the cleaning system of FIG. 1 in a return-to-operation mode.

Once the first solvent portion 148 and second solvent portions 150 have been formed, valves 131*b*, 131*c* are opened while valves 131*a*, 131*d* are closed such that second solvent 126 within rinse tank 124 can be pumped into the recovery tank 136 such that amount of second solvent portion 150 increases. As second solvent portion 150 increases, the first solvent portion 148 rises until it reaches a recovery overflow weir 152 wherein the first solvent portion 148, comprising first solvent 112 and any soil contamination, overflows into waste tank 140 as illustrated in FIG. 8. Preferably, recovery tank 136 comprises a viewing port 154 positioned with respect to the recovery overflow weir 152 such that an operator can view the first solvent portion 148 as it overflows the recovery overflow weir 152. As the level of second solvent 126 within the recovery tank 136 increases, the second solvent portion 150 eventually approaches the level of the recovery overflow weir 152 as illustrated in FIG. 9. At this point, a majority of first solvent portion 148 has been directed into waste tank 140 such that, the valves 131*a*, 131*b*, 131*c* and 131*d* are placed into position for normal operation and the remaining components can assume normal operation status as illustrated in FIG. 10. Alternatively, overflow of the first solvent portion 148 can be automated through installation of a suitable optical sensor such as, for example, a photo eye or camera to visually distinguish between the first solvent portion 148 and the second solvent portion 150.

For successful operation of the bi-solvent cleaning system 100, it is not necessary that all of the first solvent 112 be removed from the recovery tank 136 but only that the boiling point of the solvent mixture 146 be reduced so as to approach the boiling point of the second solvent 126. The first solvent 112 (including any dissolved particulates and contaminants) within waste tank 140 can than be recycled, recovered or disposed of as appropriate. Preferably, first solvent 112 is a VOC exempt solvent such that it can be incinerated or used as a fuel stream source. As described, the bi-solvent cleaning system 100 can be especially economically advantageous where the unit price of the second solvent 126 is greater than the unit price of the first solvent 112.

It is understood that this invention is not intended to be unduly limited by the illustrative embodiments and examples set forth herein and that such examples and embodiments are presented by way of example only.

What is claimed is:

1. A method for cleaning a precision component comprising:

cleaning a precision component by positioning the precision component within a cleaning tank filled with a first solvent comprising a soy based VOC exempt solvent for removing contaminants from the precision component;

rinsing the precision component in a rinse tank filled with a second solvent comprising a VOC exempt solvent wherein any remaining amounts of the first solvent on the precision component are removed by the second solvent resulting so as to form a solvent mixture; and separating the solvent mixture into a first solvent portion and a second solvent portion in a recovery tank by cooling the solvent mixture such that the first solvent portion resides on top of the second solvent portion, said first solvent portion and second solvent portion being visually distinguishable by an unassisted eye, and wherein the first solvent portion can be removed from the recovery tank.

2. The method of claim 1, wherein removing the first solvent portion from the recovery tank comprises pumping the solvent mixture from the rinse tank into the recovery tank such that the first solvent portion reaches a recovery weir and overflows into a disposal tank.

3. The method of claim 1, wherein separating the solvent mixture becomes necessary when the boiling point of the solvent mixture in the recovery tank exceeds the boiling point of the second solvent by at least 10° C.

4. The method of claim 1, wherein cleaning the precision component includes inducing cavitation within the first solvent.

5. The method of claim 1, wherein cleaning the precision component includes oscillating the precision component within the first solvent.

6. The method of claim 1, wherein rinsing the precision component includes inducing cavitation with the solvent mixture.

7. The method of claim 1, wherein rinsing the precision component includes oscillating the precision component within the solvent mixture.

8. The method of claim 2, wherein pumping of the solvent mixture from the rinse tank is completed when the second solvent portion approaches the recovery weir.

9. The method of claim 2 further comprising:

removing the first solvent portion from the disposal tank.

* * * * *

UNITED STATES PATENT AND TRADEMARK OFFICE

CERTIFICATE OF CORRECTION

PATENT NO. : 7,604,702 B2
APPLICATION NO. : 11/259947
DATED : October 20, 2009
INVENTOR(S) : Mouser et al.

It is certified that error appears in the above-identified patent and that said Letters Patent is hereby corrected as shown below:

Title page, item (*) Notice: Subject to any disclaimer, the term of this patent is extended or adjusted under 35 U.S.C. 154(b) by 764 days.

Delete the phrase "764 days" and insert --981 days--.

On the title page, item (57), Abstract, Line 3:
After "provides for" delete "is".

Column 1, Line 35:
Delete "system" and insert --systems--.

Column 3, Line 63:
Delete "make" and insert --may--.

Column 4, Line 19:
Delete "1500" and insert --1500--.

Column 6, Line 2:
Delete "1500" and insert --1500--.

Column 8, Line 29:
Delete "than" and insert --then--.

Signed and Sealed this

Twenty-seventh Day of July, 2010

David J. Kappos

David J. Kappos
*Director of the United States Patent and Trademark Office*